US007304442B2

(12) United States Patent
Colwell

(10) Patent No.: US 7,304,442 B2
(45) Date of Patent: Dec. 4, 2007

(54) THREE COMPONENT PROTECTIVE HEAD GEAR POWERED BY A RECHARGEABLE BATTERY

(75) Inventor: Walter R. Colwell, 6255 Tropicana #45, Los Vegas, NV (US) 89103

(73) Assignee: Walter R. Colwell, Las Vegas, NV (US)

( * ) Notice: Subject to any disclaimer, the term of this patent is extended or adjusted under 35 U.S.C. 154(b) by 0 days.

(21) Appl. No.: 11/429,575

(22) Filed: May 5, 2006

(65) Prior Publication Data

US 2006/0202629 A1 Sep. 14, 2006

Related U.S. Application Data

(63) Continuation-in-part of application No. 10/725,766, filed on Dec. 2, 2003, now Pat. No. 7,075,250.

(51) Int. Cl.
*G05F 1/00* (2006.01)

(52) U.S. Cl. ..... 315/307; 315/291; 315/200 A; 315/185 R; 315/216; 362/106; 362/227

(58) Field of Classification Search ..... 315/312, 315/185 R, 224, 200 A, 216, 241 S, 169.3, 315/307, 360, 362; 362/105, 106, 227, 800
See application file for complete search history.

(56) References Cited

U.S. PATENT DOCUMENTS 5,040,099 A * 8/1991 Harris ..... 362/473
5,327,587 A * 7/1994 Hurwitz ..... 2/422
5,329,637 A * 7/1994 Walker ..... 2/5
5,357,409 A * 10/1994 Glatt ..... 362/105
5,426,792 A * 6/1995 Murasko ..... 2/422
5,479,325 A * 12/1995 Chien ..... 362/105
5,485,358 A * 1/1996 Chien ..... 362/106
5,544,027 A * 8/1996 Orsano ..... 362/105
5,564,128 A * 10/1996 Richardson ..... 2/422
5,570,946 A * 11/1996 Chien ..... 362/84
5,743,621 A * 4/1998 Mantha et al. ..... 362/105
5,758,947 A * 6/1998 Glatt ..... 362/105
5,871,271 A * 2/1999 Chien ..... 362/106
6,007,213 A * 12/1999 Baumgartner ..... 362/106
6,009,563 A * 1/2000 Swanson et al. ..... 2/425
6,113,244 A * 9/2000 Baumgartner ..... 362/106
6,244,721 B1 * 6/2001 Rodriguez et al. ..... 362/106
6,328,454 B1 * 12/2001 Davis ..... 362/105
6,340,234 B1 * 1/2002 Brown, Jr. ..... 362/105
6,400,101 B1 * 6/2002 Biebl et al. ..... 315/291
6,464,369 B1 * 10/2002 Vega et al. ..... 362/106
6,497,493 B1 * 12/2002 Theisen ..... 362/105
6,733,150 B1 * 5/2004 Hanley ..... 362/160
7,075,250 B2 * 7/2006 Colwell ..... 315/291
2004/0240198 A1 * 12/2004 Van Laar et al. ..... 362/105

* cited by examiner

*Primary Examiner*—Haissa Philogene
(74) *Attorney, Agent, or Firm*—Willie Krawitz

(57) ABSTRACT

A three-component, protective headgear or helmet, and circuits therefor is provided with a battery-powered LED head lamp, which may be used by construction workers, search and rescue persons, cyclists, police, fireman, and the like. The battery may be replaceable or rechargeable and has long-term, uniform output characteristics driven by unique circuitry.

8 Claims, 6 Drawing Sheets

THREE COMPONENT PROTECTIVE HEAD GEAR POWERED BY A RECHARGEABLE BATTERY

CROSS-REFERENCE TO RELATED APPLICATIONS

This application is a continuation-in-part of U.S. Ser. No. 10/725,766; filed: Dec. 2, 2003; entitled: "THREE-COMPONENT PROTECTIVE HEAD GEAR POWERED BY A RECHARGEABLE BATTERY"; now U.S. Pat. No. 7,075,250.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

This application relates to a new and improved headgear, and more specifically to a headgear or helmet providing a lighting display for use by cyclists, construction and underground workers, search and rescue persons, emergency medical workers, firemen, police, meter readers, and so forth. The lighting display may be used to define a forward pathway or to illuminate objects, or to rearwardly signal a wearer's presence.

(2) Description of Related Art Including Information Disclosed Under 37 C.F.R. 1.97 And 1.98

Various types of protective helmets providing lighting displays are known in the prior art, and typical types of these helmets are described in U.S. Pat. Nos. 5,040,099; 5,327,587; 5,329,637; 5,357,409; 5,426,792; 5,479,325; 5,544,027; 5,485,358; 5,564,128; 5,570,946; 5,743,621; 5,758,947; 5,871,271; 6,007,213; 6,009,563; 6,113,244; 6,244,721; 6,328,454; 6,340,234; 6,464,369; and, 6,497,493.

However, none of the headgear in these patents disclose a battery powered circuit for an LED array that produces a long term, uniform illumination while providing a useful device for its intended purpose. The headgear structure of this invention may be a single, or a multi-component type, such as two or three.

BRIEF SUMMARY OF THE INVENTION

A new and improved headgear is provided with a lighting display comprising an LED array powered by built-in, rechargeable batteries through a unique circuit which enables a long-term, suitably constant output.

DETAILED DESCRIPTION OF THE INVENTION

Figure 1:
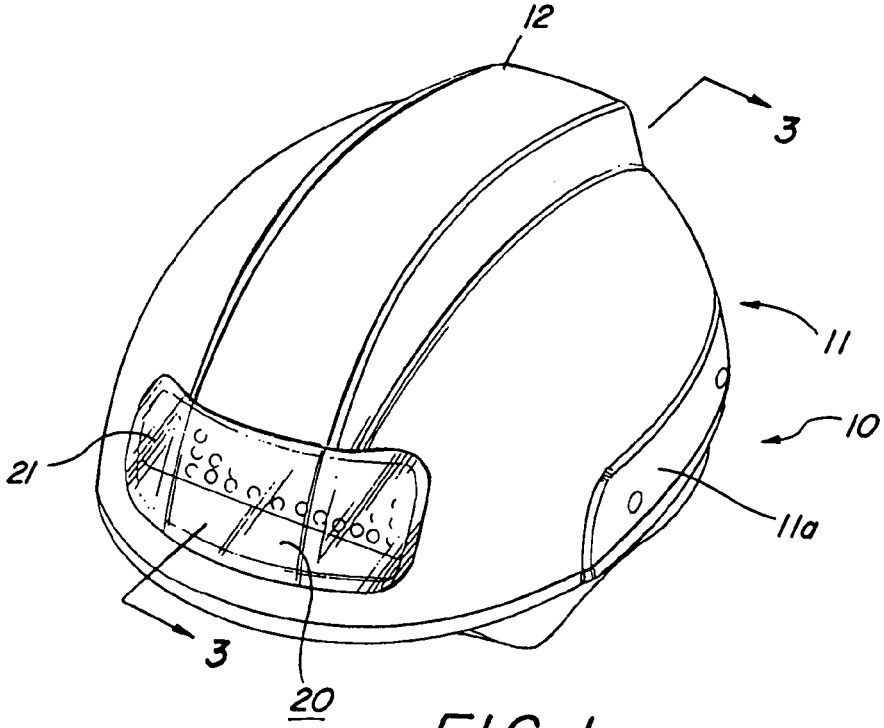
FIG. 1 is an upper perspective view of the assembled headgear of this invention.
Figure 3:
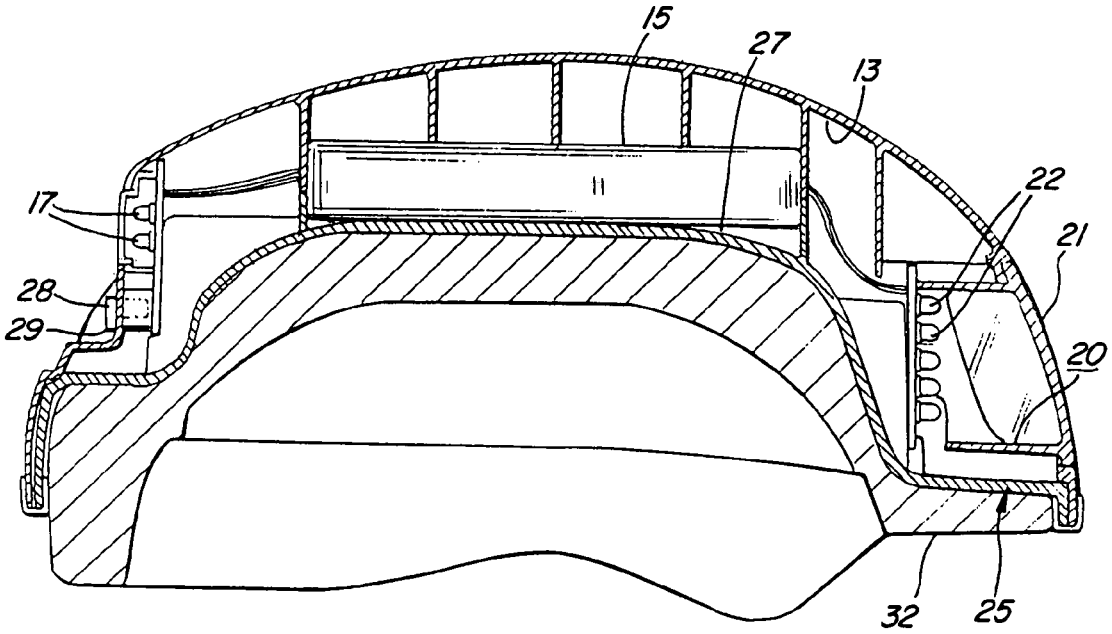
FIG. 3 is a sectional side elevation view of the headgear taken along lines 3-3 of FIG. 1.
Figure 2:
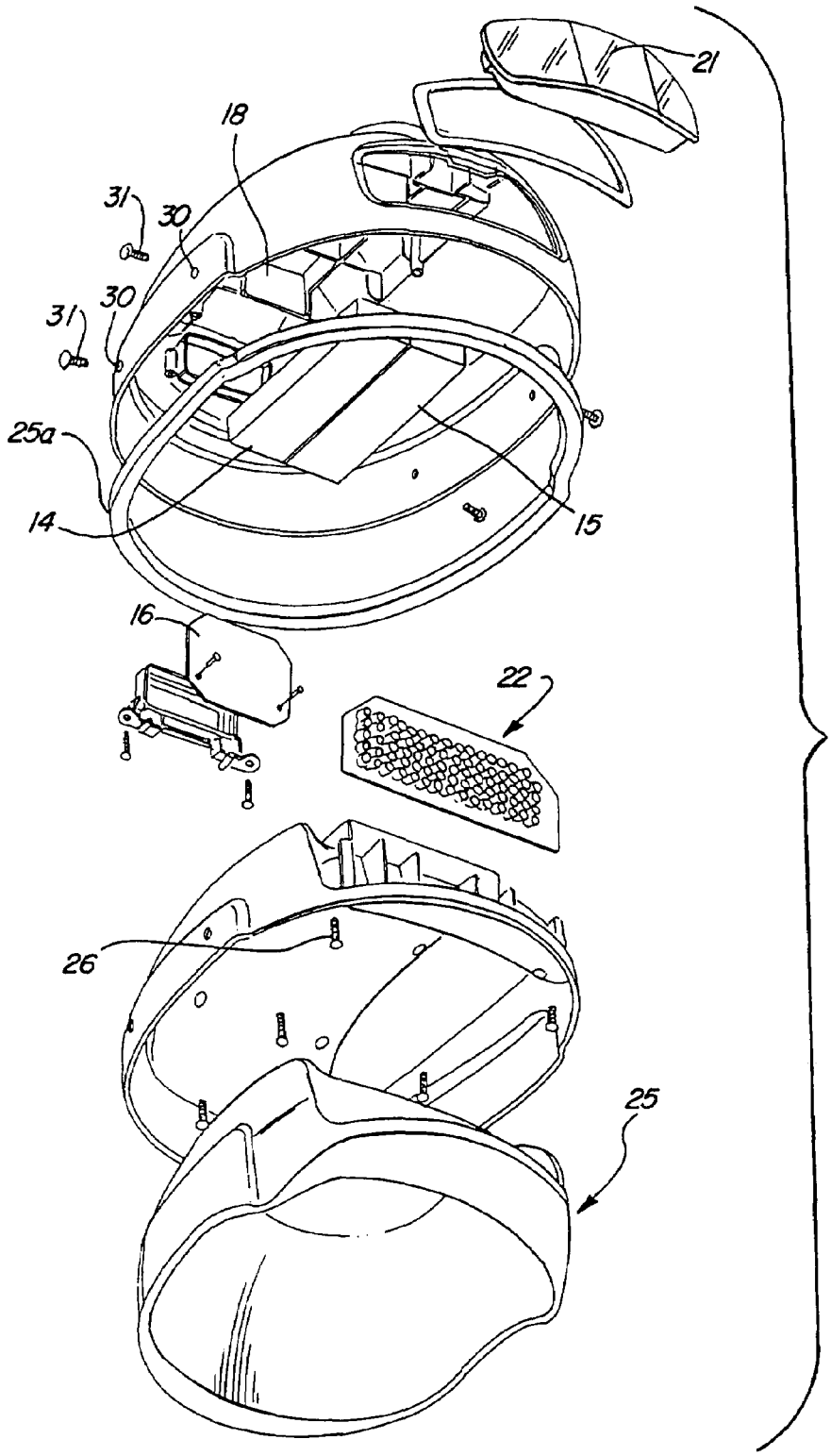
FIG. 2 is an exploded view of the upper and lower headgear components of the invention and the LED array.

The headgear 10 of this invention is shown in FIGS. 1-3, and comprises an upper helmet portion 11 defining an integrally formed, outer central reinforcing ridge 12 and a corresponding interior reinforcing grid area 13. Into the grid area 13 are mounted removable or rechargeable lithium ion battery packs 14 and 15 which connect to a circuit board 16, the circuit itself being shown in FIG. 4. Wire connections from the batteries to the circuit board and to the LED arrays are shown in FIG. 5.

A rearwardly installed LED array 17 is mounted on the upper helmet portion 11 and are connected to the circuit board and driven by the battery packs. The LED array 17 is shielded by a transparent acrylic sheet 18 mounted on the exterior of the upper helmet 11. The front area of the upper helmet 11 is provided with an enclosure 20 shielded by a curved, transparent acrylic sheet 21 which protects an enclosed, front facing LED array 22.

An interfitting helmet portion 25 is configured to interlock with the upper helmet portion 11, the two helmet portions being secured together vertically by screws 26. The helmet portion 25 defines a flat portion 27 which registers with grid area 13 and contacts the lower sides of the battery packs 14, 15 thereby securing the battery packs in place. As indicated, the front area of the helmet 25 defines the enclosure 20 into which the front facing LED array 22 is mounted.

Figure 4:
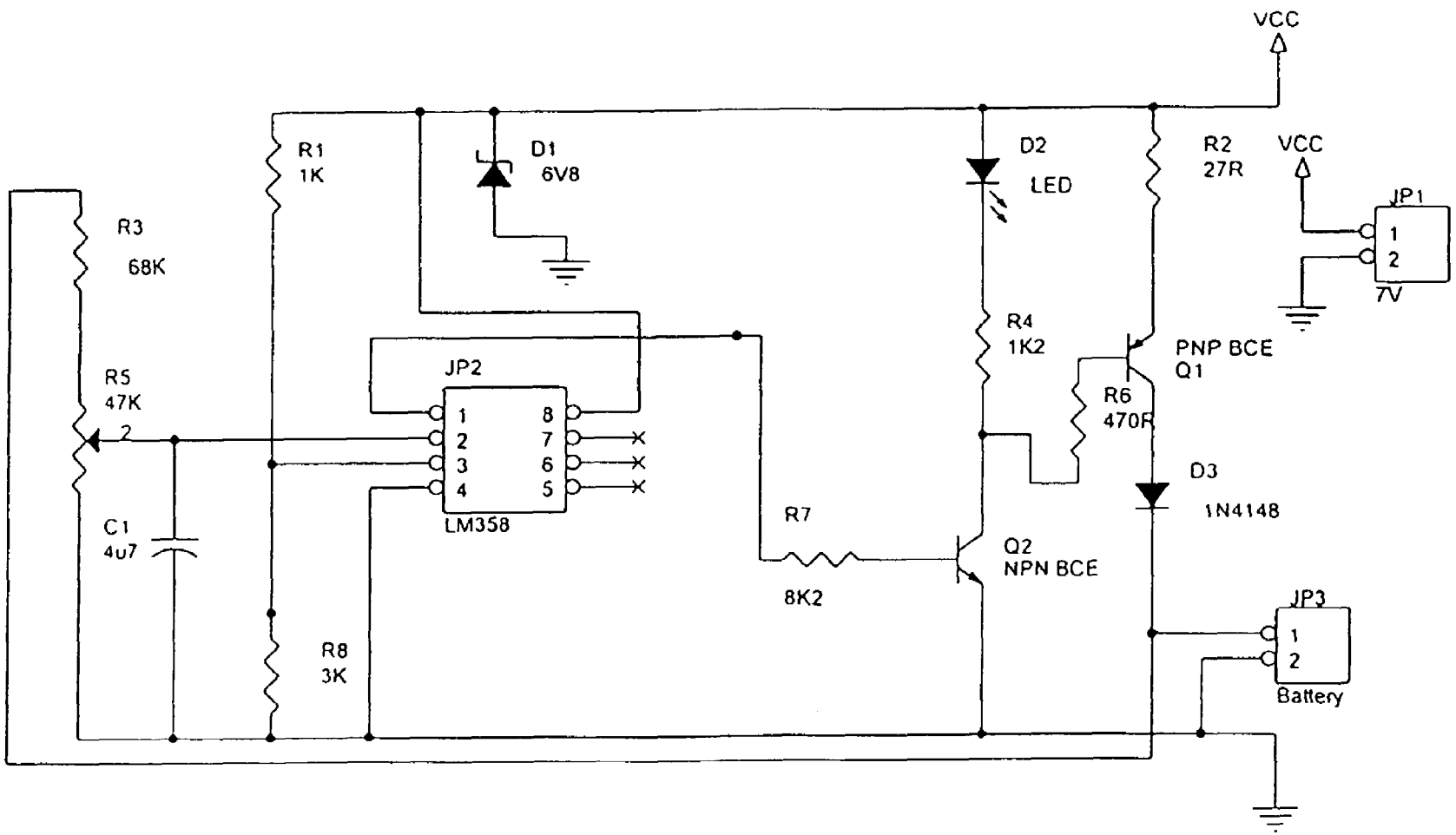
FIG. 4 is a circuit diagram of this invention for feeding power from the rechargeable batteries to the LED array.
Figure 5:
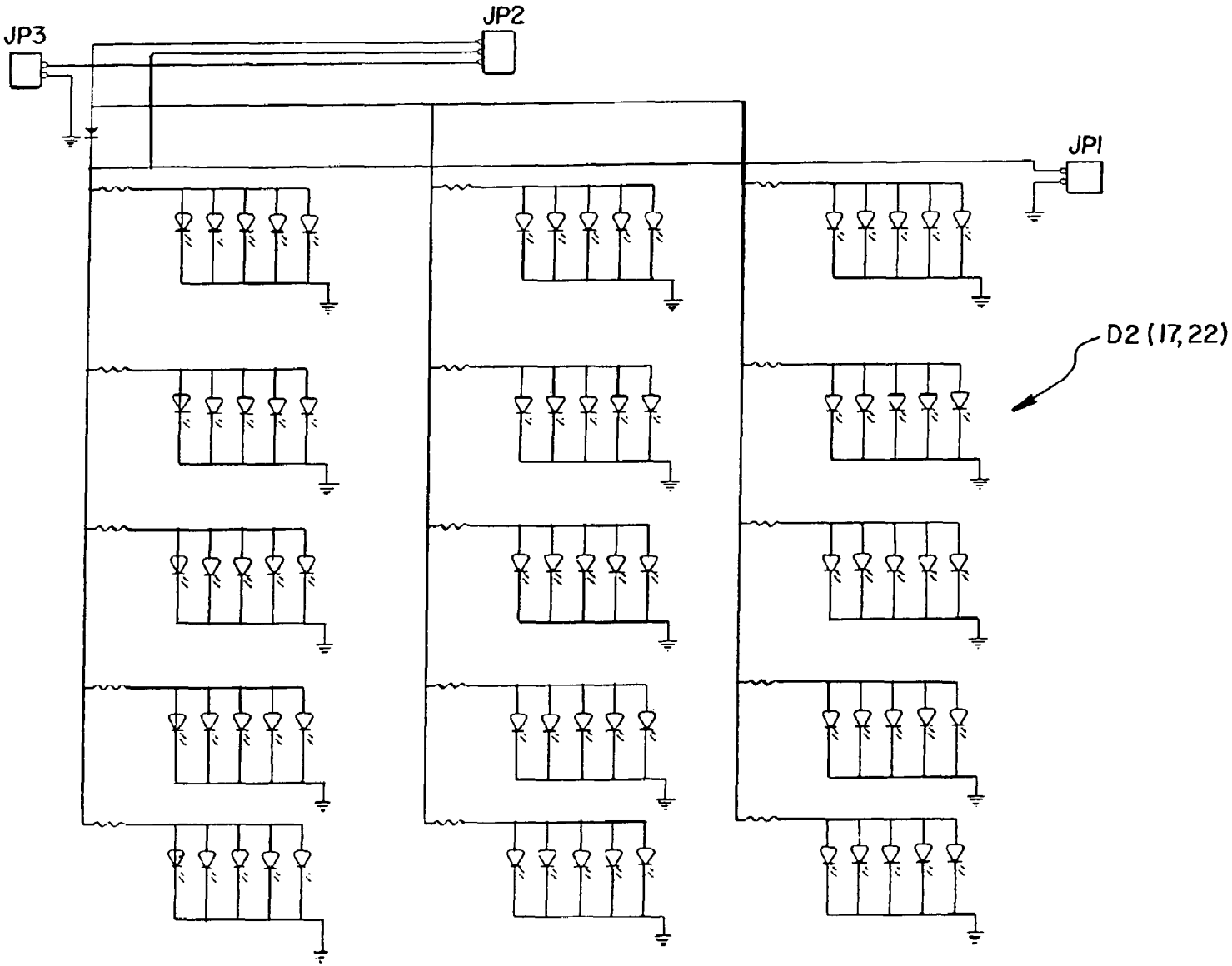
FIG. 5 shows the LED array connected to the rechargeable batteries.

The LED array 22 is driven through the circuit board 16 from the battery packs 14 and 15 as shown in FIG. 4, similarly to the LED array 17 and the circuit of FIG. 4, which will be described, infra. FIGS. 3-5 show an on-off switch 28 connected to the circuit board 16 and circuit of this invention. FIG. 3 also shows a charging outlet pin 29 for the battery packs 14 and 15, the charging pin being adjacent to the on-off switch 28. The batteries also may be removed for recharging or replacement.

An integrally formed, reinforcing wrap-around section 11*a* on the helmet portion 11 defines bores 30 coinciding with bores (not shown) in the helmet portion 25 through which pass screws 31 which horizontally secure the helmet portions 11 and 25 together. The screws 26 and 31 thereby secure the helmet portions 11 and 25 both vertically and horizontally. If desired, an edge liner 25*a* of injection molded polypropylene may be employed to engage the edges between the helmet portions 11 and 25, and thereby effect additional securement between the two helmets.

As shown in FIG. 3, a protective foam head enclosure 32 such as constructed from polyurethane or polystyrene foam is provided to cushion the wearer's head from impact against the much harder ABS plastic materials of both the helmet portions 11 and 25. Similar bores (not shown) in the head enclosure 32 register with the bores 30 and enable the helmet portions 11 and 25 and the head enclosure to be secured together using the screws 31.

The circuit shown in FIGS. 4 and 5 enables a relatively long and uniform battery power output before charging is required. The lithium ion batteries JP1 and JP3 shown in FIGS. 4 and 5 each deliver about 6600 milliamps at 7.2 volts and are isolated from each other by a diode D3. When the on-off switch 28 (FIG. 3) is turned on at JP1, the batteries JP1 and JP3 will turn on a comparator such as an op amp comparator JP2, e.g. an LM358.

The comparator JP2 shows a direct coupled amplifier configuration driven from the battery JP1 through transistors PNP Q1 and NPN Q2, and through the coupling resistance R7 to the input pin 1 of JP2. Resistances R1, R2, R3, R6/R4 respectively will protect a Zener D1, Q1, R5-JP2 and LED arrays D2 (17, 22) from excessive current/voltage.

Battery power from JP3 is applied to the voltage divider R5 and then to pin 2 of JP2, while pins 3, 4 of JP2 are both at ground. Obviously, the op amp comparator JP2 is driven by both batteries JP1 and JP3. Capacitor C1 and resistance R8 are both grounded, and provide ripple filtering, and R8 also shunts voltage from pin 3 of the JP2 to the Zener D1. JP2 (at pin 8) also drives the Zener which functions as a shunt to maintain the load voltage constant for changing current/voltage variations due to running down of the batteries. In the reverse conduction condition as shown, the Zener D1 also reduces ripple voltage.

When the switch 28 (FIG. 3) is turned on at JP1, and voltage from the voltage divider R5 exceeds the pin 3 reference voltage, the comparator JP2 (LM358) will turn on, and hence transistors Q1 and Q2 (driven from JP1 and JP3) will then turn on the LED arrays D2 (17, 22).

Typically, the lumen output of the present device for about 93 LEDs is about 4000 MCD@20 milliamps for 5-5½ hours using 7.2 volt batteries. Moreover, the device of this invention frees up the wearer's hands when viewing an operating field, especially in an emergency situation.

It will be appreciated that while a Zener diode is preferred for use in the circuit described, other semiconductor devices with similar turn-on characteristics may be utilized, and they are described in the "SCR MANUAL, INCLUDING TRIACS AND OTHER THYRISTORS" Sixth Edition, 1979 by General Electric, and incorporated herein, by reference.

Additionally, the circuit of this invention may be employed for illuminating purposes other than in a helmet, such as an LED array in a flashlight; to function as a traffic signal; as an LED turn on device used with an alarm detection system; and so forth.

Figure 6A:
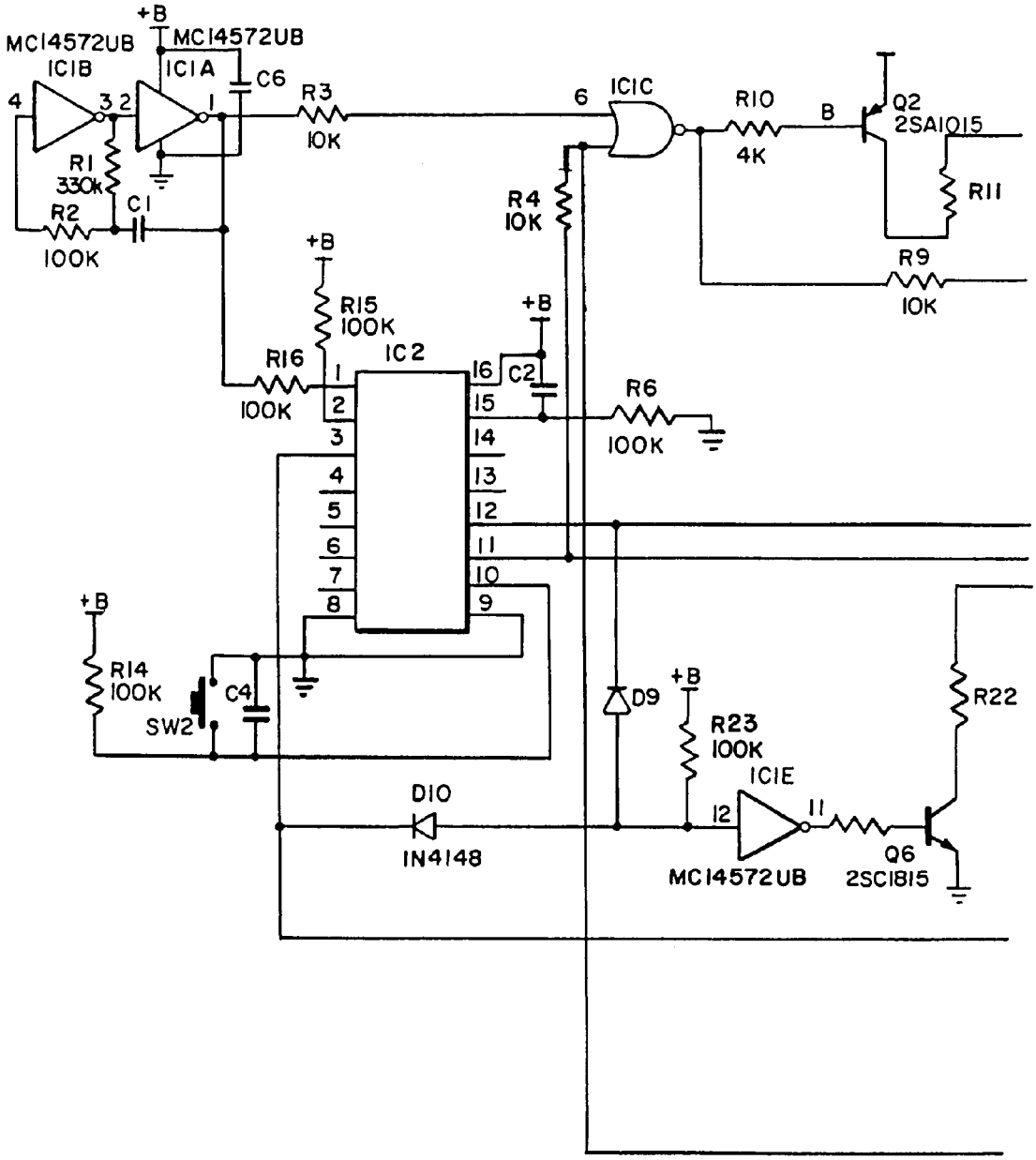
FIGS. 6A and 6B show a circuit diagram for a microprocessor controlled LED arrays to produce various display modes and formats.
Figure 6B:
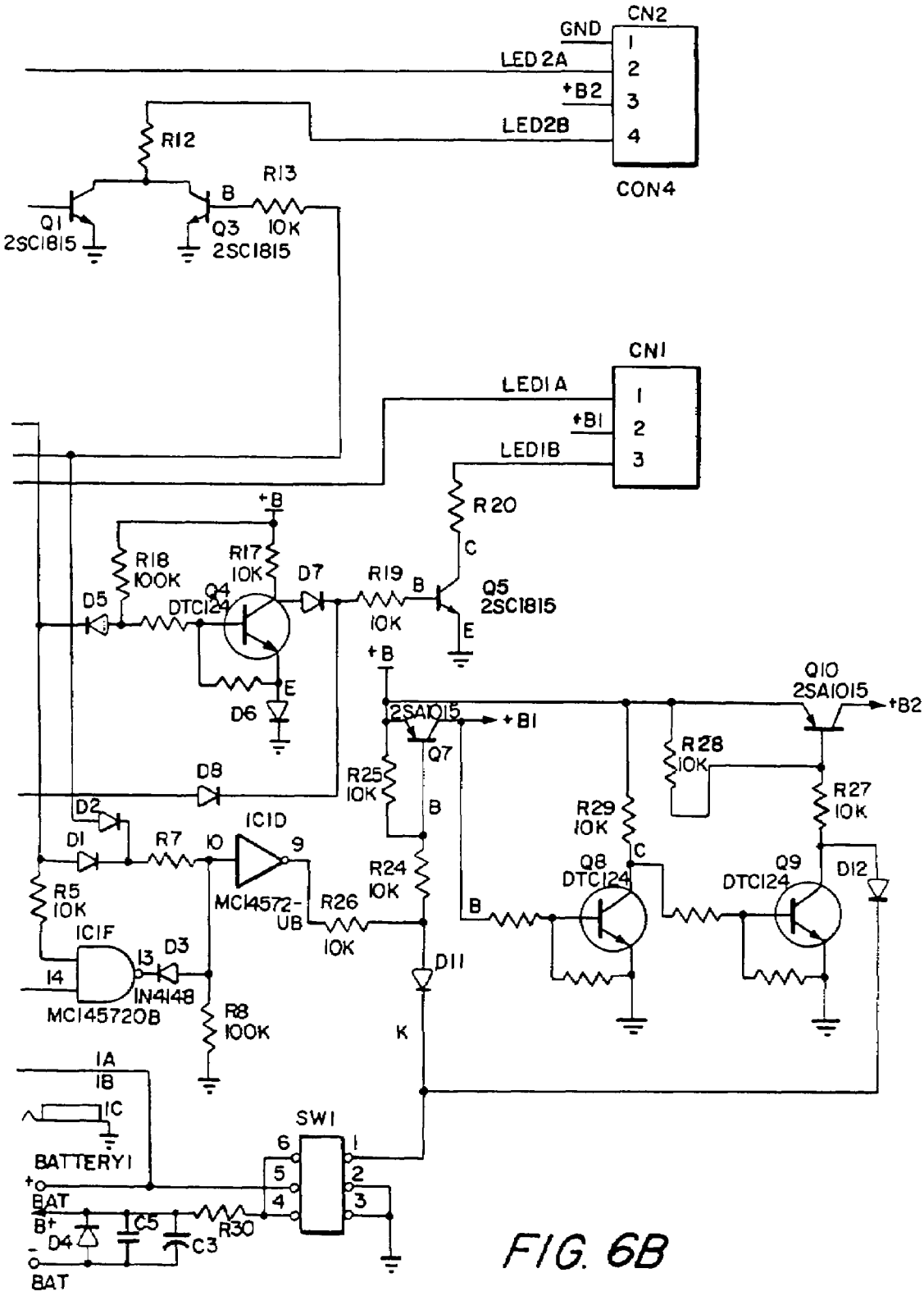

As distinguished from the mode of operation employing the comparator circuit shown in FIG. 4, the microprocessor controlled circuit is shown in FIGS. 6A, 6B, and the circuit itself may be a specific circuit board or form part of the circuit board 16 shown in FIG. 4. The microprocessor may be used to actuate LEDs for: helmets (front and/or rear); traffic signal lights; flashlights; vehicles; marine and aircraft lights; airport runway lights, etc., using a combination of blinking and continuous lights, that are shown generally in FIG. 6B.

A battery supply for the circuit shown in FIGS. 6A, 6B may be charged from a power source, including a wall plug, car cigarette lighter, etc., and the batteries are resistively connected R30 and a diode D4 to a turn-on switch SW1. The diode D4 also provides a temperature sink, while C5, C3 reduce oscillations from the batteries.

Power for the circuit is shown at various circuit locations as +B, +B1 and +B2. Battery power at +B drives major components of the circuit, while battery power at +B1, +B2 drives the LEDS. The front lights (e.g., yellow LED's) and rear lights (e.g., red LED's) are shown respectively as CN2 and CN1 on the circuit diagram. Since the front and rear lights can be programmed for display as on-off, blinking and continuous modes, various LED display combinations or formats are available.

The power distribution portion of the circuit comprises two-stage, resistance-coupled, power transistor amplifiers Q8 and Q9. Transistor Q8 is resistance connected to a pass transistor Q7 for supplying power to +B1, as shown. Transistor Q9 is connected through resistances R27 and R28 to a pass transistor Q10 for the +B2 power source which drives one set of LEDS (yellow) at CN2. Transistor Q9 distributes power to +B1 and to another set of LEDS (red) at CN1, and Q9 also supplies power to +B through resistances R27, R28 and R29. Battery +B also supplies power to pass transistor Q7 and +B1.

Use of the two pass transistors Q7 and Q10 improves power dissipation and output power regulation, particularly for a varying load, such as a blinking mode. Q8 and Q9 are grounded through respective resistances to stabilize transistor operation and to prevent thermal run-away; they may be matched and encapsulated in a single package. Diodes D11, D12 are used as heat sinks to provide additional temperature stability and to prevent drift.

A microprocessor IC2 (Motorola MC14320) is used for programming the circuit system, and is driven from the power supply +B/R15/pin 2, +B/pin 16, +B/R14/pin 10, +B/R23/pins 3, 12 and, +B/R18/pin 12. Diodes D5, D9 provide rectified power to IC2 at pin 12, and D10 provides positive voltage from +B/R23 to IC2 pin 3. Pins 8, 9 and 15 are grounded, the latter being grounded through an RC filter R6, C2. Resistance R4 provides the necessary operating level for the IC2 microprocessor output.

The microprocessor IC2 is fed a signal from a tactile switch SW2 through pins 9 and 10, the tactile switch SW2 being driven from the power supply +B through an RC filter R14 and C4. Sequence touching of the tactile switch SW2 will activate corresponding programs of IC2, and hence can activate various LED display modes. These display modes can be LED display combinations such as on-off, blinking and continuous.

As noted, battery power for CN2 is from +B2 which also provides power for LED2 A (yellow blinking) through an LED interface Q2 which may be a PNP germanium transistor. +B2 battery power is also provided for LED2 B (yellow continuous) through a differential amplifier transistor NPN pair Q1, Q3 which are resistance-coupled to LED2 B by R12. Q1, Q3 also reduce or minimize drift, and for low circuit drift requirements, Q1 and Q3 may be matched and encapsulated in a single package.

IC1A, IC1B are inverters from say a 4049 inverter package to control the pulse lighting frequency of LED2 A and LED1 A. These two inverters send a clock signal to IC2 pin 1 through R16, and the frequency and duration of the clock signal can be varied by adjusting R2, C1 which in turn determine the blinking frequency of the LED's. See for example U.S. Pat. No. 5,544,027.

The actuation signals to CN1 are from the microprocessor IC2 at pins 3 and 12. Blinking (red) LED1 A is powered from +B/R23 and an inverter IC1E (which avoids the positive pulses from D10). IC1E is coupled to an LED interface NPN transistor Q6 that is resistance coupled R22 to LED1 A of CN1. The actuation signal to IC1E is from the microprocessor IC2 at pin 3.

Power for LED1 B continuous (red) is from +B through Q4 which drives an interface transistor Q5 that is resistance coupled R20 to continuous LED1 B (red). Q4, Q5 and Q6 are grounded and function similarly to Q8, Q9 and Q1, Q3 to prevent a run away temperature excursion and to impart drift stability.

In one mode of operating the LEDs, when the SW1 switch is first turned on, the output of IC1A, IC1B and IC2 are fed to an OR gate IC1C. With IC1A and IC1B in the "ON" state, the OR gate IC1C will pass the pulse signals to the LED interface Q2 which is resistance-coupled (R11) to LED2 A (yellow blinking) of CN2.

The output from pin 11 of IC2 will be fed through resistance R4 to the OR gate IC1C. Hence, when the switch SW1 is initially turned on, the program of IC2 will light LED2 A as a yellow blinking mode; CN2 of course will be in an ON mode.

Thus for the above mode, during LED operations when the switch SW1 is initially closed, the IC2 microprocessor program will be actuated causing LED2 A to blink, the blinking frequency signal depending on the R2, C1 setting of the 4049 inverter IC1B and IC1A. This frequency signal is sent to the inverter gate IC1C along with the microprocessor output from IC2. The inverter gate IC1C will pass both output signals to activate CN2 and LED2 A, causing LED2 A to blink ON yellow, and CN1 to be ON red.

A first touching of the tactile switch SW2 will turn off LED2 A, and the output signal from IC1C will then be resistance coupled (R9) from +B2 to the differential amplifiers Q1 and Q3. This will cause LED2 B to turn ON continuously (yellow) and CN1 (red) to remain ON. To turn off LED2 A and turn on LED2 B, the microprocessor IC2 will send appropriate signals to IC1C from pin 11 and R4, and also through the coupling resistance R13 to the differential amplifier Q1, Q3 to control LED2 B (yellow ON) at CN2 and to control LED1 B (continuous red ON).

During the time CN2 is activated, CN1 may be disabled by signals from IC1C and pins 11, 12 of IC2. These two IC2 signals are applied to diodes D1, D2 which drive an inverter IC1D. A signal from IC2 (pin 12), is also applied to a gate IC1F and diode D3 (or a Zener).

The diode D3 (or Zener) functions to maintain the load voltage constant for changing current/voltage variations due to running down of the batteries. In the reverse conduction condition as shown, D3 or the Zener will also smooth and reduce ripple voltage from D1, D2 to the inverter IC1D, which will thereby invert the entire reduced positive ripple voltage from D1 and D2. When applied to the opposite positive power supply from +B1, the smoothed and reduced inverted signal from IC1D is sufficient to disable the +B1 power source, without affecting the positive +B power supply.

As indicated, supra, various modes of LED functions are possible, for example when the SW1 switch of the unit is first turned on, initially the front lights of LED2 A may be turn ON in a blinking mode yellow and LED1 B can turn ON continuously red.

A first touching of the tactile switch SW2 will cause the IC2 program to turn off the blinking yellow at LED2 A, turn on a continuous yellow at LED2 B; LED1 B remains continuously ON red.

A second tactile touching of SW2 will turn off the continuous yellow mode and red modes and also turn on both CN1 and CN2 to blinking. Thus, both CN1 and CN2 will be changed from continuous to blinking modes. This is accomplished by sending turn off signals to gate IC1C and hence Q1, Q3; this will disable +B2. With diodes D1, D2 and gate IC1F being turned off, the +B1 power supply will be restored.

A third touching of SW2 will turn SN2 blinking yellow OFF to continuous yellow ON, while SN1 will turn red continuous ON, and, the cycle may then be repeated.

Operationally, the third touching of the tactile switch SW2 (supra) will send a turn OFF signal to LED1 A from the microprocessor IC2, pin 3 and the program will actuate Q4 from pin 12. This will turn LED1 B ON continuously red, while LED2 B of CN2 will be turned ON continuously yellow.

In a second example of an LED display mode or format, when the unit is first turned ON at SW1, the IC2 program will cause LED2 A to be a blinking yellow ON, and SN1 red will be OFF.

A first touching of the SW2 tactile switch will cause the IC2 program to turn yellow SN2 OFF, and turn LED1 B ON continuously red.

A second touching of SW2 will turn SN2 yellow OFF and turn on CN1 and LED1 A to a blinking mode (red).

A third touching of SW2 will turn LED2 A ON blinking yellow and turn on LED1 A as a blinking red, and the program cycle can be repeated.

Thus, the circuit of this invention has the advantage of enabling use of a device in various on-off, blinking and continuous modes. For example, suitable modes could be used to control traffic lights at signal orientations of say 90° and/or 180°. Another mode could include displaying left and right hand turn blinking or continuous yellow and/or red signals, rather than displaying a continuous red turn signal. Minimizing a continuous red signal could reduce waiting turn times for non-existing oncoming or cross traffic, as can frequently be the case.

Moreover, the circuit of this invention can also reduce battery power requirements when used for example in helmets and flashlights by using the device in a blinking mode rather than in a continuous mode, the latter which consumes greater energy. Also, battery power consumption can be reduced by changing the blink frequency setting of R2, C1 in the 4049 package.

The invention claimed is:

1. A protective helmet including at least one illuminating LED array, including a circuit being driven by at least one battery for powering transistor amplifier means to drive the array, and provide various display modes, the circuit comprising a programmable microprocessor for controlling the LED array, the microprocessor being programmed to actuate a combination of display modes including turn-on, turn-off, continuous and blinking displays, and a battery-driven, tactile switch connected to the microprocessor for sequentially activating programmed pulses and thereby actuate a cycle of display modes, the amplifier means and associated connectors to the circuit being arranged and constructed to stabilize circuit operation, and a semiconductor device for maintaining a constant load voltage due to current/voltage variations due to running down of the battery.

2. The protective helmet of claim 1, providing front and rear LED displays.

3. The protective helmet of claim 2, providing differing color displays for the front and rear LEDS.

4. The protective helmet of claim 2, including circuit means for disabling only one LED display.

5. The protective helmet of claim 1, in which the semiconductor device is a diode or Zener.

6. The protective helmet of claim 1, in which the diode or Zener in a reverse conduction condition reduces or smooths ripple voltage.

7. The protective helmet of claim 1, including means for sending a clock signal to the microprocessor, the clock signal including adjustable components for varying the duration and timing of the clock signal and corresponding variations of pulse frequency and duration of a blinking LED display.

8. A comparator circuit for illuminating an LED array, the circuit being driven by at least one battery for powering transistor amplifying means to drive the array, the circuit comprising: an operational amplifier comparator, the battery providing an input voltage and a reference voltage through a voltage divider for the comparator, the comparator being turned on when the input voltage exceeds the reference voltage a Zener diode semiconductor device actuated by the comparator, and functioning as a shunt to maintain (the) a load voltage constant for voltage/current variations as the battery is worn down, and the transistor amplifiers being connected to the battery, Zener semiconductor device and operational amplifier comparator for turning on the LED array, the batteries providing about 6000 milliamps @ 7.2 volts, and the LED array providing about 4000 MCD @ about 20 milliamps for about 5-5½ hours for about 93 LEDs in the arrays; and, a microprocessor controlled circuit for illuminating an LED array, the circuit being driven by at least one battery for the transistor amplifying means to drive the array and provide various display modes for front and rear LED displays, including circuit means for disabling only one LED display, the circuit comprising a programmable microprocessor for controlling the LED array, the microprocessor being programmed to actuate a combination of display modes including turn-on, turn-off, continuous and blinking displays and a battery-driven, tactile switch connected to the microprocessor for sequentially activating programmed pulses and thereby actuate a cycle of display modes, the transistor amplifying means and associated connectors to the circuit being arranged and constructed to stabilize circuit operation, and Zener semiconductor devices for maintaining a constant load voltage due to current/voltage variations due to running down of the battery; the comparator and microprocessor circuits being mounted on specific circuit boards or, mounted onto a combined circuit board.

* * * * *